US010939723B2

(12) United States Patent
Walborn et al.

(10) Patent No.: US 10,939,723 B2
(45) Date of Patent: Mar. 9, 2021

(54) INSOLE FOR AN ORTHOPEDIC DEVICE

(71) Applicant: OSSUR HF, Reykjavik (IS)

(72) Inventors: Jonathan Walborn, Mission Viejo, CA (US); Zachariah J. Klutts, Irvine, CA (US); Harry Duane Romo, Aliso Viejo, CA (US)

(73) Assignee: OSSUR HF, Reykjavik (IS)

( * ) Notice: Subject to any disclaimer, the term of this patent is extended or adjusted under 35 U.S.C. 154(b) by 887 days.

(21) Appl. No.: 14/489,805

(22) Filed: Sep. 18, 2014

(65) Prior Publication Data

US 2015/0075030 A1 Mar. 19, 2015

Related U.S. Application Data

(60) Provisional application No. 61/879,312, filed on Sep. 18, 2013.

(51) Int. Cl.
*A43B 7/14* (2006.01)
*A43B 1/00* (2006.01)
(Continued)

(52) U.S. Cl.
CPC ..... *A43B 7/14* (2013.01); *A43B 1/0009* (2013.01); *A43B 7/141* (2013.01); *A43B 7/147* (2013.01);
(Continued)

(58) Field of Classification Search
CPC ..... A43B 7/144; A43B 7/1445; A43B 13/122; A43B 13/188; A43B 13/04; A43B 7/142;
(Continued)

(56) References Cited

U.S. PATENT DOCUMENTS 975,576 A 11/1910 Sexton
1,012,017 A 12/1911 Salt
(Continued)

FOREIGN PATENT DOCUMENTS

CN 101711141 A 5/2010
CN 102026592 A 4/2011
(Continued)

OTHER PUBLICATIONS

International Search Report from PCT Application No. PCT/US2016/014816, dated Apr. 28, 2016.
(Continued)

*Primary Examiner* — Alissa J Tompkins
*Assistant Examiner* — Catherine M Ferreira
(74) *Attorney, Agent, or Firm* — Workman Nydegger

(57) ABSTRACT

An insole for an orthopedic device includes a top portion including at least one top layer. The top layer defines a top surface arranged to be substantially adjacent a plantar surface of a user's foot. A bottom portion is connected to and arranged opposite the top portion. The bottom portion includes at least one bottom layer. At least one removable element is arranged for removal from at least the bottom portion for defining at least one opening below the top surface. The top surface continuously spans over the at least one opening arranged for off-loading one or more affected areas of the plantar surface of the foot.

10 Claims, 6 Drawing Sheets

(51) Int. Cl.
*A43B 13/38* (2006.01)
*A43B 13/40* (2006.01)

(52) U.S. Cl.
CPC ..... *A43B 7/1465* (2013.01); *A43B 13/383* (2013.01); *A43B 13/386* (2013.01); *A43B 13/40* (2013.01)

(58) Field of Classification Search
CPC ... A43B 13/141; A43B 7/1425; A43B 13/181; A43B 13/02; A43B 13/189; A43B 17/006; A43B 13/14; A43B 13/16; A43B 5/00; A43B 13/12; A43B 13/125; A43B 7/141; A43B 7/14; A43B 1/0009; A43B 13/386
USPC ..... 36/44, 88, 93, 95, 110
See application file for complete search history.

(56) References Cited

U.S. PATENT DOCUMENTS 2,200,849 A 5/1940 Margolin
2,236,367 A 3/1941 Gruber
2,292,297 A 8/1942 Sherlock
2,444,640 A 7/1948 Epstein
2,868,191 A * 1/1959 Juhasz ..... A61H 7/002 15/215
2,885,797 A 5/1959 Chrencik
2,888,016 A 5/1959 De Lamater
2,909,854 A 10/1959 Edelstein
2,913,837 A 11/1959 Geuder
2,917,844 A 12/1959 Scholl
2,928,193 A 3/1960 Kristan
2,979,835 A 4/1961 Scholl
2,979,836 A 4/1961 Scholl
3,270,358 A 9/1966 Milner
3,464,126 A 9/1969 Sarkissian
3,548,420 A * 12/1970 Spence ..... A61F 2/7812 128/889
3,580,248 A 5/1971 Larson
3,681,860 A 8/1972 Bidegain
3,685,176 A 8/1972 Rudy
3,730,169 A 5/1973 Fiber
3,735,758 A 5/1973 Novotney
3,760,056 A 9/1973 Rudy
3,786,805 A 1/1974 Tourin
3,792,537 A 2/1974 Plank et al.
3,814,088 A 6/1974 Raymond
3,834,377 A 9/1974 Lebold
3,859,740 A 1/1975 Kemp
3,922,800 A 12/1975 Miller et al.
3,955,565 A 5/1976 Johnson, Jr.
4,045,888 A 9/1977 Oxenberg
4,057,056 A 11/1977 Payton
4,095,353 A 6/1978 Foldes
4,100,686 A * 7/1978 Sgarlato ..... A43B 13/20 36/29
4,142,307 A 3/1979 Martin
4,177,583 A 12/1979 Chapman
4,184,273 A 1/1980 Boyer et al.
4,217,706 A 8/1980 Vartanian
4,217,893 A 8/1980 Payton
4,232,459 A 11/1980 Vaccari
4,237,626 A 12/1980 Brown
4,267,649 A 5/1981 Smith
4,300,294 A 11/1981 Riecken
4,333,248 A 6/1982 Samuels
4,370,818 A 2/1983 Simoglou
4,408,402 A 10/1983 Looney
4,414,965 A 11/1983 Mauldin et al.
D272,281 S 1/1984 Alush
4,446,856 A 5/1984 Jordan
4,494,536 A 1/1985 Latenser
4,505,269 A 3/1985 Davies et al.
4,550,721 A 11/1985 Michel
4,565,017 A 1/1986 Ottieri
4,571,853 A * 2/1986 Medrano ..... A43B 17/08 36/29
4,572,169 A 2/1986 Mauldin et al.
4,587,962 A 5/1986 Greene et al.
4,598,484 A 7/1986 Ma
4,599,811 A 7/1986 Rousseau
4,608,768 A 9/1986 Cavanagh
4,620,378 A 11/1986 Sartor
4,633,598 A 1/1987 Moronaga et al.
4,633,599 A 1/1987 Morell et al.
4,633,877 A 1/1987 Pendergast
4,660,300 A 4/1987 Morell et al.
4,669,202 A 6/1987 Ottieri
4,674,204 A 6/1987 Sullivan et al.
4,674,205 A 6/1987 Anger
4,677,767 A 7/1987 Darby
4,680,878 A 7/1987 Pozzobon et al.
4,689,898 A 9/1987 Fahey
4,719,710 A 1/1988 Pozzobon
4,727,661 A 3/1988 Kuhn
4,741,115 A 5/1988 Pozzobon
4,748,726 A 6/1988 Schoch
4,760,653 A 8/1988 Baggio
4,771,768 A 9/1988 Crispin
4,773,170 A 9/1988 Moore et al.
4,793,078 A 12/1988 Andrews
D299,787 S 2/1989 Bates
4,805,321 A 2/1989 Tonkel
4,805,601 A 2/1989 Eischen, Sr.
4,811,504 A 3/1989 Bunke
4,869,001 A 9/1989 Brown
4,872,273 A 10/1989 Smeed
4,879,822 A 11/1989 Hayes
4,893,418 A 1/1990 Ogden
4,934,355 A 6/1990 Porcelli
4,947,838 A 8/1990 Giannetti
4,974,583 A 12/1990 Freitas
5,065,481 A 11/1991 Walkhoff
5,065,531 A 11/1991 Prestridge
5,078,128 A 1/1992 Grim et al.
5,123,180 A 6/1992 Nannig et al.
5,125,400 A 6/1992 Johnson, Jr.
D329,527 S 9/1992 Cohen
5,143,058 A 9/1992 Luber et al.
D330,109 S 10/1992 Hatfield
5,152,038 A 10/1992 Schoch
5,154,682 A * 10/1992 Kellerman ..... A43B 1/0072 36/44
5,154,695 A 10/1992 Farris et al.
5,157,813 A 10/1992 Carroll
5,176,623 A 1/1993 Stetman et al.
5,176,624 A 1/1993 Kuehnreich
5,183,036 A 2/1993 Spademan
5,197,942 A 3/1993 Brady
D334,646 S 4/1993 Dissinger
D337,876 S 8/1993 Kilbey
5,233,767 A 8/1993 Kramer
5,242,379 A 9/1993 Harris et al.
5,257,470 A 11/1993 Auger et al.
5,277,695 A 1/1994 Johnson, Jr. et al.
D344,589 S 2/1994 Kilbey
5,288,286 A 2/1994 Davis et al.
5,325,613 A 7/1994 Sussmann
5,329,705 A 7/1994 Grim et al.
D352,191 S 11/1994 Zorian
D352,784 S 11/1994 Cohen et al.
5,359,791 A 11/1994 Prahl et al.
5,368,549 A 11/1994 McVicker
5,368,551 A 11/1994 Zuckerman
5,370,133 A 12/1994 Darby et al.
5,378,223 A 1/1995 Grim et al.
5,399,152 A 3/1995 Habermeyer et al.
5,407,421 A 4/1995 Goldsmith
5,425,701 A 6/1995 Oster et al.
5,426,872 A 6/1995 Hayes
5,429,377 A 7/1995 Duer
5,429,588 A 7/1995 Young et al.
5,433,695 A 7/1995 Drennan

(56) References Cited

U.S. PATENT DOCUMENTS 5,435,009 A 7/1995 Schild et al.
5,438,768 A * 8/1995 Bauerfeind ..... A43B 7/1425 36/165
5,441,015 A 8/1995 Farley
D363,780 S 10/1995 Darby et al.
5,464,385 A 11/1995 Grim
5,477,593 A 12/1995 Leick
D365,919 S 1/1996 Chen
5,483,757 A 1/1996 Frykberg
5,496,263 A 3/1996 Fuller, II et al.
5,548,848 A 8/1996 Huybrechts
D373,548 S 9/1996 Losi, II
5,558,627 A 9/1996 Singer et al.
D375,191 S 11/1996 Tonkel et al.
5,577,998 A 11/1996 Johnson, Jr. et al.
D376,429 S 12/1996 Antar
5,617,650 A 4/1997 Grim
D379,258 S 5/1997 Cheng
5,641,322 A 6/1997 Silver et al.
5,647,104 A 7/1997 James
5,656,226 A 8/1997 McVicker
D383,250 S 9/1997 Amico
D384,746 S 10/1997 Varn
D390,345 S 2/1998 Aird et al.
5,717,996 A 2/1998 Feldmann
D391,748 S 3/1998 Koh
5,761,834 A 6/1998 Grim et al.
5,778,563 A 7/1998 Ahlbaumer
5,778,565 A 7/1998 Holt et al.
5,797,862 A 8/1998 Lamont
D398,142 S 9/1998 Benoit
D398,439 S 9/1998 McDonald
5,819,378 A 10/1998 Doyle
5,827,210 A 10/1998 Antar et al.
5,827,211 A 10/1998 Sellinger
D401,042 S 11/1998 Davis
5,833,639 A 11/1998 Nunes et al.
5,836,902 A 11/1998 Gray
5,846,063 A 12/1998 Lakic
5,853,380 A 12/1998 Miller
5,857,987 A 1/1999 Habermeyer
D404,895 S 2/1999 Rosato
5,868,690 A 2/1999 Eischen, Sr.
5,913,841 A 6/1999 Lamont
5,934,599 A 8/1999 Hammerslag
5,951,504 A 9/1999 Iglesias et al.
5,961,477 A 10/1999 Turtzo
5,993,404 A 11/1999 Mc Niel
6,000,148 A 12/1999 Cretinon
D418,967 S 1/2000 Stengel
6,021,780 A 2/2000 Darby
6,027,468 A 2/2000 Pick
6,044,578 A 4/2000 Kelz
6,098,315 A 8/2000 Hoffmann, III
6,131,195 A 10/2000 Foreman
6,202,953 B1 3/2001 Hammerslag
6,205,685 B1 3/2001 Kellerman
D440,754 S 4/2001 Bathum
6,228,044 B1 5/2001 Jensen et al.
6,267,742 B1 7/2001 Krivosha et al.
RE37,338 E 8/2001 McVicker
6,289,558 B1 9/2001 Hammerslag
6,334,854 B1 1/2002 Davis
6,338,768 B1 1/2002 Chi
6,361,514 B1 3/2002 Brown et al.
6,377,178 B1 4/2002 Detoro et al.
6,409,691 B1 6/2002 Dakin et al.
D461,936 S 8/2002 Fiorini et al.
6,432,073 B2 8/2002 Pior et al.
D467,708 S 12/2002 Portzline
D473,654 S 4/2003 Iglesias et al.
D473,704 S 4/2003 Wilson
6,572,571 B2 6/2003 Lowe
D476,799 S 7/2003 Fuerst
6,589,194 B1 7/2003 Calderon et al.
6,682,497 B2 1/2004 Jensen et al.
6,755,798 B2 6/2004 McCarthy et al.
6,792,699 B2 9/2004 Long et al.
D500,855 S 1/2005 Pick et al.
6,866,043 B1 3/2005 Davis
D504,005 S 4/2005 Schoenborn et al.
D505,727 S 5/2005 Krahner et al.
6,945,944 B2 9/2005 Kuiper et al.
6,976,972 B2 12/2005 Bradshaw
6,991,613 B2 1/2006 Sensabaugh
D517,306 S 3/2006 Hoeft
7,010,823 B2 3/2006 Baek
7,018,351 B1 3/2006 Iglesias et al.
D523,217 S 6/2006 Matis et al.
D528,214 S 9/2006 Binet
7,198,610 B2 4/2007 Ingimundarson et al.
7,281,341 B2 10/2007 Reagan et al.
7,288,076 B2 10/2007 Grim et al.
D554,835 S 11/2007 Peydro
D555,291 S 11/2007 Danzo
D555,343 S 11/2007 Bettencourt
7,303,538 B2 12/2007 Grim et al.
7,311,686 B1 12/2007 Iglesias et al.
7,354,411 B2 4/2008 Perry et al.
RE40,363 E 6/2008 Grim et al.
7,384,584 B2 6/2008 Jerome et al.
D575,039 S 8/2008 Amado et al.
D576,781 S 9/2008 Chang et al.
7,418,755 B2 9/2008 Bledsoe et al.
D583,544 S 12/2008 Fuerst
D583,956 S 12/2008 Chang et al.
7,493,706 B2 2/2009 Cho et al.
7,524,295 B1 4/2009 Peters et al.
D592,755 S 5/2009 Chang et al.
D592,756 S 5/2009 Chang et al.
D594,368 S 6/2009 Butler
D596,301 S 7/2009 Campos et al.
D596,386 S 7/2009 Brambilla
7,591,050 B2 9/2009 Hammerslag
D603,155 S 11/2009 Della Valle et al.
D614,775 S 4/2010 Snively
D615,285 S 5/2010 Martin
D616,556 S 5/2010 Hu
7,717,869 B2 5/2010 Eischen, Sr.
7,727,174 B2 6/2010 Chang et al.
D622,494 S 8/2010 Warren
7,838,717 B2 11/2010 Haggstrom et al.
D634,438 S 3/2011 Hu
D634,852 S 3/2011 Hu
D636,157 S 4/2011 Nascimento
D636,159 S 4/2011 Petrie
7,964,766 B2 6/2011 Blott et al.
D642,363 S 8/2011 Rajmohan et al.
D642,775 S 8/2011 Raysse
8,002,724 B2 8/2011 Hu et al.
8,012,112 B2 9/2011 Barberio
8,021,347 B2 9/2011 Vitaris et al.
D648,113 S 11/2011 Chang
RE43,063 E * 1/2012 Kim ..... B29C 45/14336 429/174
D651,381 S 1/2012 Simms
8,158,844 B2 4/2012 McNeil
D661,887 S 6/2012 Petrie
8,308,705 B2 11/2012 Lin et al.
8,313,449 B2 11/2012 Hardman et al.
D675,421 S 2/2013 Petrie
D677,866 S 3/2013 Vestuti et al.
D680,728 S 4/2013 Stryjak
D682,517 S 5/2013 Taylor
D683,214 S 5/2013 Mcadam
D684,760 S 6/2013 Williams, Jr.
8,506,510 B2 8/2013 Hu et al.
D689,677 S 9/2013 Bathum et al.
8,574,181 B2 11/2013 Bird et al.
D696,499 S 12/2013 Lehtinen
D696,785 S 12/2013 Weaver, II et al.
D698,074 S 1/2014 Hargreaves
D698,338 S 1/2014 Ingham et al.
D700,404 S 2/2014 Niefer

(56) References Cited

U.S. PATENT DOCUMENTS

| | | | |
|---|---|---|---|
| D701,032 | S | 3/2014 | Leleu |
| D701,033 | S | 3/2014 | Leleu |
| D703,335 | S | 4/2014 | Bird et al. |
| D709,277 | S | 7/2014 | Takenaka |
| D712,639 | S | 9/2014 | Spring |
| D714,042 | S | 9/2014 | Petrie |
| 9,003,677 | B2 | 4/2015 | Goodsmith et al. |
| D729,393 | S | 5/2015 | Dunn et al. |
| D740,896 | S | 10/2015 | Halper, Jr. |
| D742,017 | S | 10/2015 | Dunn et al. |
| D744,111 | S | 11/2015 | Dunn et al. |
| 9,220,621 | B2 | 12/2015 | Hu et al. |
| 9,220,622 | B2 | 12/2015 | Ingimundarson et al. |
| 9,248,042 | B2 | 2/2016 | Lopez et al. |
| 9,333,106 | B2 | 5/2016 | Hu et al. |
| 9,468,553 | B2 | 10/2016 | Hu et al. |
| D772,418 | S | 11/2016 | Dunn et al. |
| 9,492,301 | B2 | 11/2016 | Hu et al. |
| D776,288 | S | 1/2017 | Dunn et al. |
| D776,289 | S | 1/2017 | Dunn et al. |
| 9,668,907 | B2 | 6/2017 | Romo et al. |
| 9,744,065 | B2 | 8/2017 | Walborn et al. |
| 9,839,548 | B2 | 12/2017 | Ingvarsson et al. |
| 9,839,549 | B2 | 12/2017 | Walborn et al. |
| 9,839,550 | B2 | 12/2017 | Walborn et al. |
| 2002/0095105 | A1 | 7/2002 | Jensen |
| 2002/0095750 | A1 | 7/2002 | Hammerslag |
| 2002/0128574 | A1 | 9/2002 | Darby |
| 2003/0093882 | A1 | 5/2003 | Gorza et al. |
| 2003/0171703 | A1 | 9/2003 | Grim et al. |
| 2003/0204938 | A1 | 11/2003 | Hammerslag |
| 2004/0010212 | A1 | 1/2004 | Kuiper et al. |
| 2004/0019307 | A1 | 1/2004 | Grim et al. |
| 2004/0167453 | A1 | 8/2004 | Peters |
| 2005/0131324 | A1 | 6/2005 | Bledsoe |
| 2005/0145256 | A1 | 7/2005 | Howard et al. |
| 2005/0165338 | A1 | 7/2005 | Iglesias et al. |
| 2005/0171461 | A1 | 8/2005 | Pick |
| 2005/0172517 | A1 | 8/2005 | Bledsoe et al. |
| 2005/0274046 | A1 | 12/2005 | Schwartz |
| 2006/0084899 | A1 | 4/2006 | Verkade et al. |
| 2006/0135899 | A1 | 6/2006 | Jerome et al. |
| 2006/0135902 | A1 | 6/2006 | Ingimundarson et al. |
| 2006/0156517 | A1 | 7/2006 | Hammerslag et al. |
| 2006/0189907 | A1 | 8/2006 | Pick et al. |
| 2006/0217649 | A1 | 9/2006 | Rabe |
| 2006/0229541 | A1 | 10/2006 | Hassler et al. |
| 2007/0055188 | A1 | 3/2007 | Avni et al. |
| 2007/0167884 | A1 | 7/2007 | Mangrum et al. |
| 2007/0169378 | A1 | 7/2007 | Sodeberg et al. |
| 2007/0185425 | A1 | 8/2007 | Einarsson et al. |
| 2007/0191749 | A1 | 8/2007 | Barberio |
| 2007/0282230 | A1 | 12/2007 | Valderrabano et al. |
| 2007/0293798 | A1 | 12/2007 | Hu et al. |
| 2008/0060167 | A1 | 3/2008 | Hammerslag et al. |
| 2008/0060168 | A1 | 3/2008 | Hammerslag et al. |
| 2008/0066272 | A1 | 3/2008 | Hammerslag et al. |
| 2008/0066345 | A1 | 3/2008 | Hammerslag et al. |
| 2008/0066346 | A1 | 3/2008 | Hammerslag et al. |
| 2008/0083135 | A1 | 4/2008 | Hammerslag et al. |
| 2008/0294082 | A1 | 11/2008 | Chang et al. |
| 2008/0294083 | A1 | 11/2008 | Chang et al. |
| 2009/0012482 | A1 | 1/2009 | Pinto et al. |
| 2009/0099495 | A1 | 4/2009 | Campos et al. |
| 2009/0227927 | A1 | 9/2009 | Frazer |
| 2009/0270820 | A1 | 10/2009 | Johnson et al. |
| 2009/0287127 | A1 | 11/2009 | Hu et al. |
| 2009/0287128 | A1 | 11/2009 | Ingimundarson et al. |
| 2010/0069808 | A1 | 3/2010 | Mitchell |
| 2010/0100020 | A1 | 4/2010 | Fout et al. |
| 2010/0234782 | A1 | 9/2010 | Hu et al. |
| 2010/0324461 | A1 | 12/2010 | Darby, II et al. |
| 2011/0009791 | A1 | 1/2011 | Hopmann |
| 2011/0015555 | A1 | 1/2011 | Anderson et al. |
| 2011/0196275 | A1 | 8/2011 | Chang et al. |
| 2012/0010534 | A1 | 1/2012 | Kubiak et al. |
| 2012/0035560 | A1 | 2/2012 | Eddy et al. |
| 2012/0078148 | A1 | 3/2012 | Hu et al. |
| 2012/0220960 | A1 | 8/2012 | Ruland |
| 2012/0238924 | A1 | 9/2012 | Avni |
| 2013/0066247 | A1 | 3/2013 | Bird et al. |
| 2013/0310721 | A1 | 11/2013 | Hu et al. |
| 2014/0128789 | A1 | 5/2014 | Chen |
| 2014/0171837 | A1 | 6/2014 | Harcourt |
| 2014/0276310 | A1 | 9/2014 | Grim et al. |
| 2014/0350446 | A1 | 11/2014 | Gunnsteinsson |
| 2015/0164179 | A1 | 6/2015 | Walborn et al. |
| 2016/0213823 | A1 | 7/2016 | Walborn et al. |

FOREIGN PATENT DOCUMENTS

| | | | |
|---|---|---|---|
| DE | 23 416 58 | A1 | 3/1974 |
| DE | 32 287 53 | A1 | 2/1984 |
| EP | 0 095 396 | A1 | 11/1983 |
| EP | 0 201 051 | A1 | 11/1986 |
| EP | 0770368 | A1 | 5/1997 |
| EP | 2468323 | A1 | 6/2012 |
| FR | 2 399 811 | A1 | 3/1979 |
| FR | 2 634 988 | A1 | 2/1990 |
| FR | 2 681 516 | A1 | 3/1993 |
| GB | 2 124 473 | A | 2/1984 |
| GB | 2 178 940 | A | 2/1987 |
| JP | 2005211626 | A | 8/2005 |
| WO | 93/13685 | A1 | 7/1993 |
| WO | 93/24081 | A1 | 12/1993 |
| WO | 94/18863 | A1 | 9/1994 |
| WO | 97/36507 | A1 | 10/1997 |
| WO | 20041021817 | A1 | 3/2004 |
| WO | 2006/035469 | A2 | 4/2006 |
| WO | 2006045079 | A1 | 4/2006 |
| WO | 2007078845 | A2 | 7/2007 |
| WO | 2010/104824 | A1 | 9/2010 |
| WO | 2013/084213 | A1 | 6/2013 |
| WO | 2015006766 | A1 | 1/2015 |

OTHER PUBLICATIONS

European Search Report from corresponding European Application No. EP 15 20 0198.8, dated May 20, 2016.

International Search Report from PCT Application No. PCT/US2009/003018, dated Jul. 24, 2009.

Product Information Sheet: Nextep Contour Walker, Procare, DJ Orthopedics, Jan. 1, 2008,1 page. Retrieved from the internet, www.djortho.com.

Product Information Sheet: Nextep Contour w/Air Walker, Procare, DJ Orthopedics, Jan. 1, 2008, 1 page. Retrieved from internet, www.djortho.com.

Product Information Sheet: XP Achilles Walker (EU only), Aircast, Jan. 1, 2008, 4 pages. Retrieved from the internet, http://www.aircast.com/index.asp/fuseaction/products.detail/cat/2/id/104.

Product Information Sheet: XP Diabetic Walker System, Aircast, Jan. 1, 2008, 4 pages. Retrieved from the internet, http://www.aircast.com/index.asp/fuseaction/products.detail/cat/2/id/15.

Product Information Sheet: SP Walker (short pneumatic), Aircast, Jan. 1, 2008, 4 pages. Retrieved from the internet, http://www.aircast.com/index.asp/fuseaction/products.detail/cat/2/id/14.

Product Information Sheet: FP Walker (foam pneumatic), Aircast, Jan. 1, 2008, 4 pages. Retrieved from the internet, http://www.aircast.com/index.asp/fuseaction/products.detail/cat/2/id/75.

Product Information Sheet: XP Walker (extra pneumatic), Aircast, Jan. 1, 2008, 4 pages. Retrieved from the internet, http://www.aircast.com/index.asp/fuseaction/products.detail/cat/2/id/76.

International Search Report and Written Opinion from International Application No. PCT/US2014/057421, dated Dec. 8, 2014.

International Search Report and Written Opinion from International Application No. PCT/US2014/069686, dated Mar. 13, 2015.

Chinese Office Action from CN Application No. 201480052921.0, dated Feb. 4, 2017.

(56) References Cited

OTHER PUBLICATIONS

International Search Report and Written Opinion for corresponding International Application No. PCT/US2014/056201, dated Dec. 5, 2014.

* cited by examiner

INSOLE FOR AN ORTHOPEDIC DEVICE

TECHNICAL FIELD

The disclosure relates to an insole for an orthopedic device for off-loading one or more affected areas on the plantar surface of a user's foot.

BACKGROUND

Diabetics are subject to especially severe and difficult foot problems. As the condition of diabetes gets worse, many diabetic patients develop a problem called neuropathy where they lose the sense of feeling in the plantar surface or bottom of the foot which may extend from the toes up the foot to the heel and eventually up to the lower leg or higher. Because there is little or no feeling, these patients are subject to severe pressure induced ulcerations that can be caused by high peak pressures or hard foreign particles that may get in their shoe or orthopedic device and which they do not realize are present. This often results in foot ulcers or ulceration of delicate skin, which in diabetic patients is often difficult to heal. Sometimes the foot ulcers become infected, contain scar tissue, and may cause secondary problems up to and including amputation.

Efforts have been taken in the past to solve the problem by attempting to control the pressure on the plantar surface of the foot. One conventional type of treatment includes the use of an off-loading insole with removable shapes cut into the upper surface of the insole. Grids of the removable shapes are removed from the upper surface to offload plantar foot pressure in the ulcerated area. While this insole can control plantar foot pressure, it has several serious drawbacks. For instance, it causes increased pressure around the edge of the ulcerated area, which may restrict blood flow to the ulcer site. It can also cause window edema. It can also cause a distended wound because the exudate coming out of the ulcerated area eventually granulates to form scar tissue within the openings created by the removed shapes. Sometimes, such scar tissue must be shaved off to avoid high pressure in that area when the foot is placed in a normal shoe. Movement of the foot position on top of the insole can cause a foot ulcer to move across the openings in the upper surface, aggravating the ulcer site.

SUMMARY

The disclosure describes various embodiments of an insole providing a construction and design allowing for greater protection and customized relief to one or more affected areas on the plantar surface of a user's foot. The embodiments described include at least one removable element arranged to be removed from the underside of the insole for defining at least one opening below a top surface of the insole, off-loading one or more affected areas on the plantar surface of a user's foot, while the top surface of the insole continuously extends over the at least one opening, protecting the plantar surface of the foot from the at least one opening. The solution provided by the disclosure reduces pressure points on the plantar surface of the foot from the at least one opening which can be both uncomfortable and harmful.

The embodiments include an insole for an orthopedic device having a top portion including at least one top layer. The top layer defines a top surface arranged to be substantially adjacent a plantar surface of a user's foot. A bottom portion is connected to and arranged opposite the top portion. The bottom portion includes at least one bottom layer. At least one removable element is arranged for removal from at least the bottom portion for defining at least one opening below the top surface. The top surface continuously spans over the at least one opening arranged for off-loading one or more affected areas of the plantar surface of the foot. This advantageously allows a user, clinician, or medical professional to selectively remove the at least one removable element from bottom portion of the insole for off-loading affected areas of the foot while the top surface of the top portion forms a protective barrier between the foot and the resulting openings, reducing or eliminating pressure points along the plantar surface of the foot from the opening. A user, clinician, or medical professional can remove at least one element from the bottom portion of the insole to form at least one opening below the top surface without disrupting the contact area between the top surface and the plantar surface of the foot, substantially increasing comfort and reducing friction.

The arrangement of the top surface continuously spanning over the at least one opening in the bottom portion of the insole also substantially prevents the buildup of fluids and/or exudate in the openings rather than allowing the fluids and/or exudate to collect in the openings, as in the prior art. This reduces the likelihood of window edema and/or the formation of distended wounds due to the at least one opening.

According to a variation, the at least one top layer is heat formable so that the top layer is shapeable to substantially match the shape of the plantar surface of the foot. This has the effect of distributing forces from the foot to larger areas of the top layer, reducing the likelihood of pressure points.

According to a variation, a retaining member is removably attached to and positioned below the bottom portion of the insole. This can help maintain the at least one removable element between the top surface and the retaining member.

While described in a walker, the insole may be used in a post-surgical shoe, a diabetic shoe, or any other suitable orthopedic device.

BRIEF DESCRIPTION OF THE DRAWINGS

These and other features, aspects, and advantages of the present disclosure will become better understood regarding the following description, appended claims, and accompanying drawings.

DETAILED DESCRIPTION OF VARIOUS EMBODIMENTS

Figure 1:
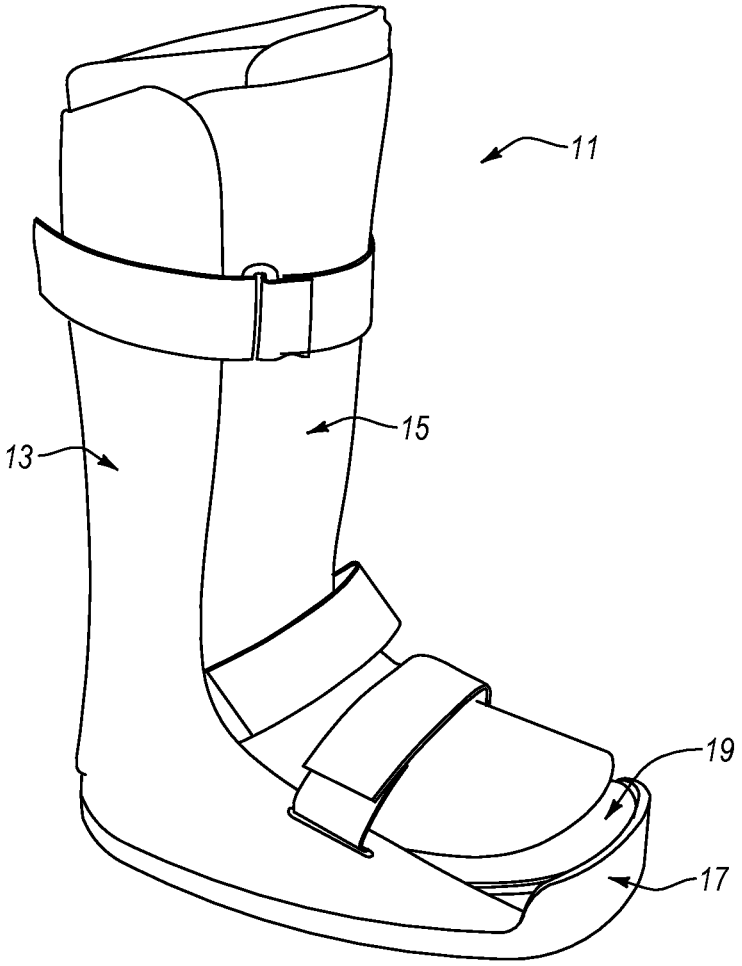
FIG. 1 is an isometric view of an orthopedic device in which the exemplary embodiments of an insole may be implemented.

A better understanding of different embodiments of the disclosure may be had from the following description read with the accompanying drawings in which like reference characters refer to like elements.

While the disclosure is susceptible to various modifications and alternative constructions, certain illustrative embodiments are in the drawings and described below. It should be understood, however, there is no intention to limit the disclosure to the embodiments disclosed, but on the contrary, that the intention covers all modifications, alternative constructions, combinations, and equivalents falling with the spirit and scope of the disclosure.

For further ease of understanding the embodiments of an orthopedic device as disclosed, a description of a few terms is necessary. As used, the term "dorsal" has its ordinary meaning and refers to the top surfaces of the foot, ankle and foreleg or shin. As used, the term "plantar" has its ordinary meaning and refers to a bottom surface, such as the bottom of a foot. As used, the term "proximal" has its ordinary meaning and refers to a location closer to the heart than another location. Likewise, the term "distal" has its ordinary meaning and refers to a location further from the heart than another location. The term "posterior" also has its ordinary meaning and refers to a location behind or to the rear of another location. Lastly, the term "anterior" has its ordinary meaning and refers to a location ahead of or to the front of another location.

The terms "rigid," "flexible," and "resilient" may be used to distinguish characteristics of portions of certain features of the orthopedic device. The term "rigid" should denote that an element of the device is generally devoid of flexibility. Within the context of support members or shells that are "rigid," it is intended to indicate that they do not lose their overall shape when force is applied, and that they may break if bent with sufficient force. The term "flexible" should denote that features are capable of repeated bending such that the features may be bent into retained shapes or the features do not retain a general shape, but continuously deform when force is applied. The term "resilient" is used to qualify such flexible features as returning to an initial general shape without permanent deformation. As for the term "semi-rigid," this term is used to connote properties of support members or shells that provide support and are free-standing; however, such support members or shells may have degree of flexibility or resiliency.

The exemplary embodiments of an insole can be used in various orthopedic devices, including, but not limited to, configurations of walkers or walking boots, post-surgical shoes, diabetic shoes, or any other suitable orthopedic device.

For instance, exemplary embodiments of an insole can be implemented with an orthopedic device comprising a walker 11, as shown in FIG. 1. An exemplary walker 11 can include a base shell 13 and a dorsal shell 15, such that that the lower leg is generally fully enclosed and supported by the walker 11. An outsole 17 can be provided along the distal plantar surface of the walker 11. The dorsal shell 15 can be moveable away and towards the base shell 13 to open and close the walker 11. In this exemplary device 11, an insole 19 can be arranged in a foot bed of the walker 11. The insole 19 can be configured to provide protection and relief to affected areas on the plantar surface of a user's foot. While a circumferential walker is shown, it will be appreciated that other walkers (e.g., a strut walker) may utilize similar insole configurations.

Figure 2:
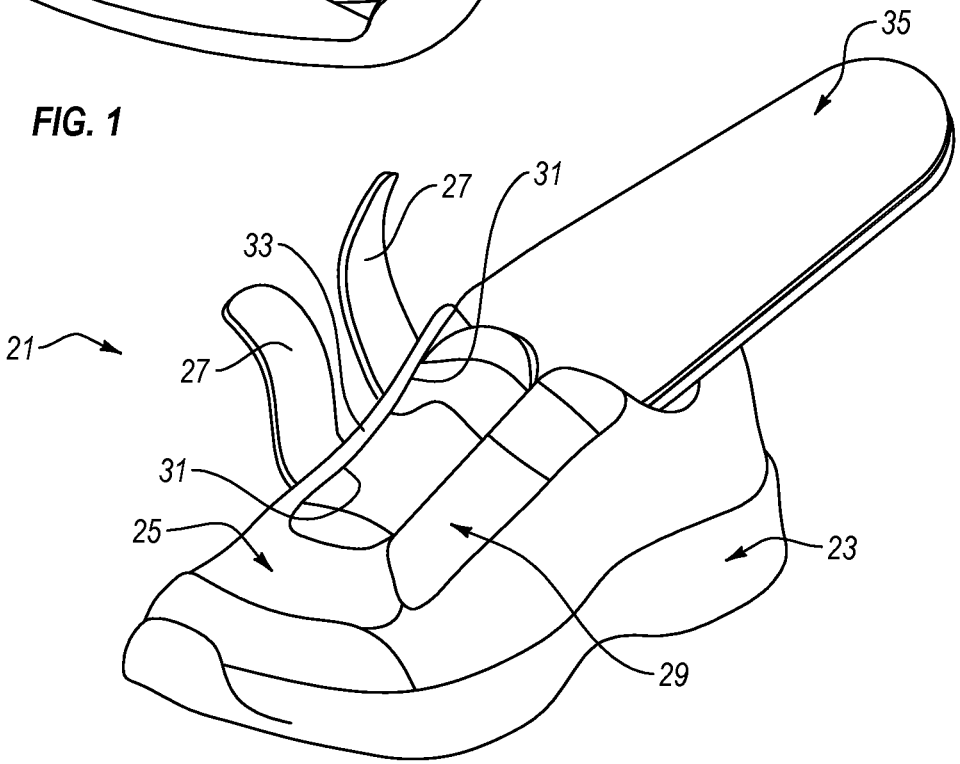
FIG. 2 is an isometric view of another orthopedic device in which the exemplary embodiments of an insole may be implemented.
Figure 3:
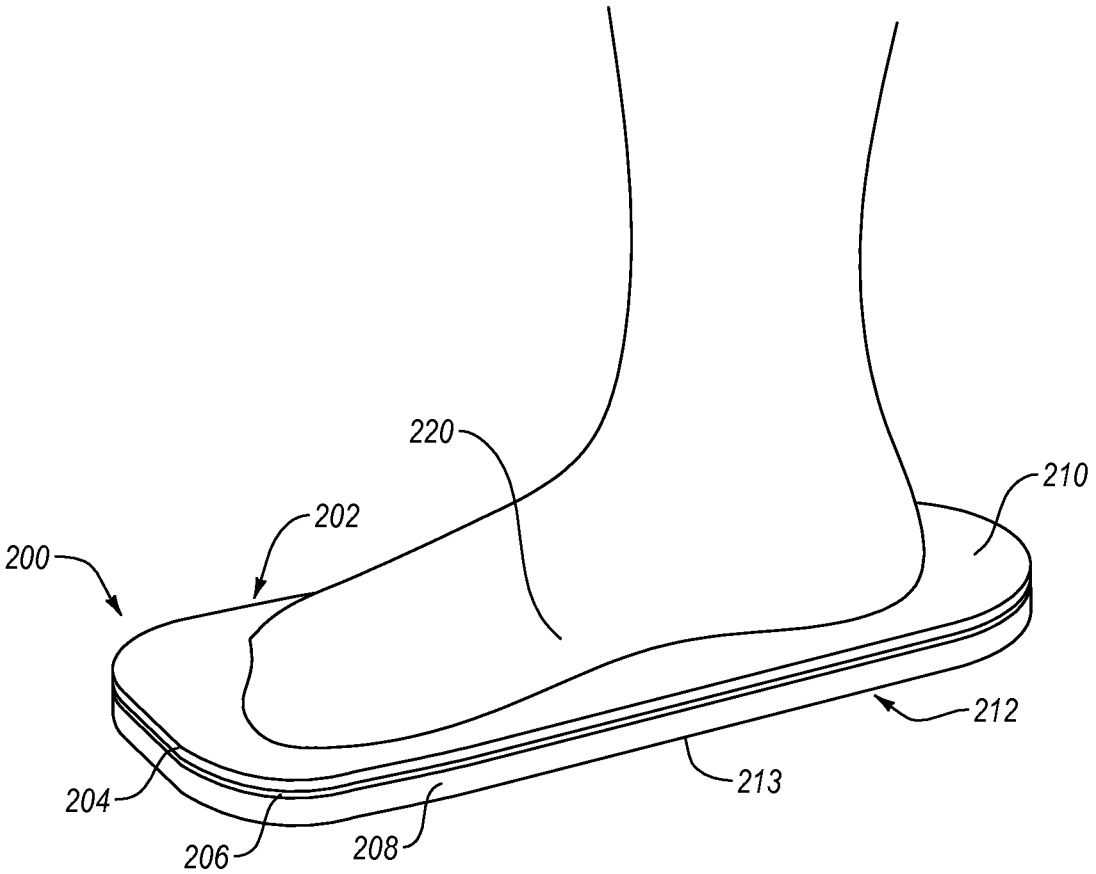
FIG. 3 is a top isometric view of an insole according to an embodiment.

Further, exemplary embodiments of an insole can be implemented with an orthopedic device comprising a diabetic shoe 21, as shown in FIG. 2. The diabetic shoe 21 can include an outsole 23, an upper portion 25, and straps 27 for holding the shoe closed. The straps 27 can be mounted on a first closure flap 29 of the shoe 21, extend through openings 31 in a second closure flap 33 and then can be held in a closed position by a closure system on the straps 27 and the first closure flap 29. An insole 35 according to an exemplary embodiment can be arranged in a foot bed of the shoe 21.

Referring now to FIGS. 3-7, a first exemplary embodiment of an insole 200 comprises a top portion 202 and a bottom portion 212 connected to and arranged opposite the top portion 202. The top portion 212 includes a first or top layer 204. The top layer 204 can define a top surface 210 arranged to be substantially adjacent a plantar surface of a user's foot. The bottom portion 212 can include a second or bottom layer 208 and a third or intermediate layer 206. The intermediate layer 206 can be attached to the top layer 204, and the bottom layer 208 can be attached to the intermediate layer 206. The bottom layer 208 can define a bottom surface 213 of the bottom portion 212. While the top portion 202 is shown including one layer and the bottom portion 212 is shown including two layers, the top portion 202 and/or the bottom portion 212 can include one, two, four, or any other suitable number of layers.

Figure 4:
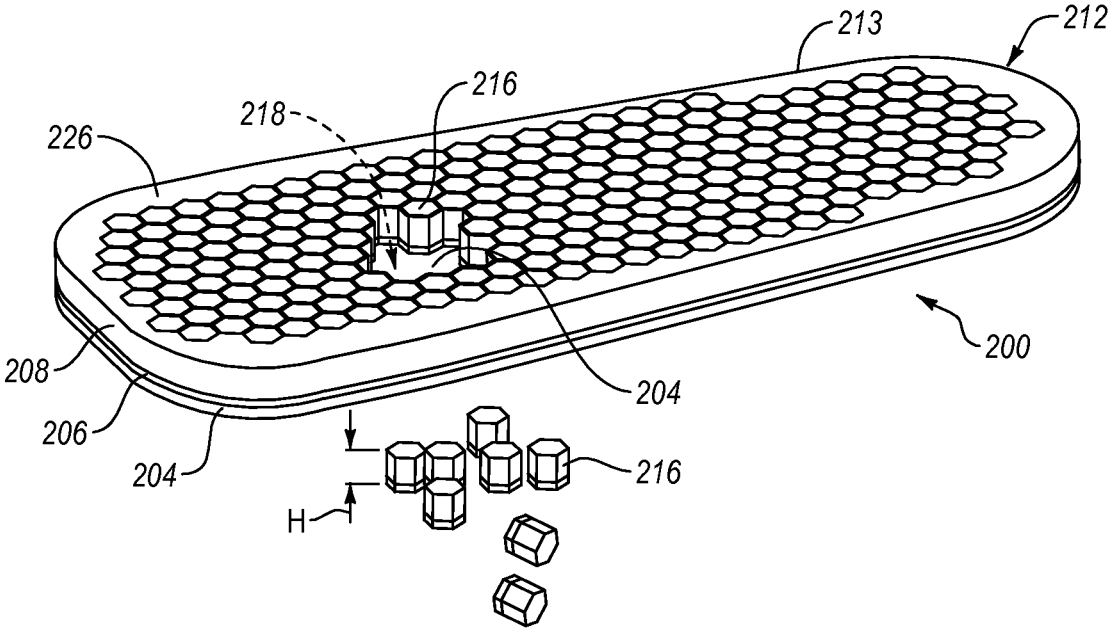
FIG. 4 is a bottom isometric view of the insole in FIG. 3 showing some of the removable inserts removed from the insole.

FIG. 4 shows a plurality of removable elements 216 can be cut or otherwise formed in the bottom portion 212 of the insole 200. The removable elements 216 can be cut or formed in substantially the entire bottom portion 212 of the insole 200. The removable elements 216 can be cut or formed in select or discrete portions of the bottom portion 212. While a plurality of removable elements 216 are described, it will be appreciated that the insole can include at least one removable element 216.

One or more of the removable elements 216 can be arranged for removal from at least the bottom portion 212 for defining at least one opening 218 below the top surface 210. For instance, some of the removable elements 216 can be removed from the bottom surface 213 of the bottom portion 212 to define the opening 218 below the top surface 210. The opening 218 can be arranged for off-loading one or more affected areas (e.g., a foot ulcer, a sore, a wound, a bruise, a fracture, etc.) of the plantar surface of the user's foot. At least one element 216 can be removed from the bottom portion 212 of the insole 200 to define the opening 218 below the top surface 210, providing relief or "off-loading" to one or more affected areas on the foot 220, while the top surface 210 of the insole 200, next to the skin or sock, protects the plantar surface of the foot from the opening 218, reducing the likelihood of pressure points along the plantar surface of the foot. While the opening 218 is shown, it will be appreciated that the removable elements 216 can be removed from the bottom portion 212 to define two, three, four, five, or any other suitable number of openings for off-loading one or more affected areas of the plantar surface of the foot.

Figure 5:
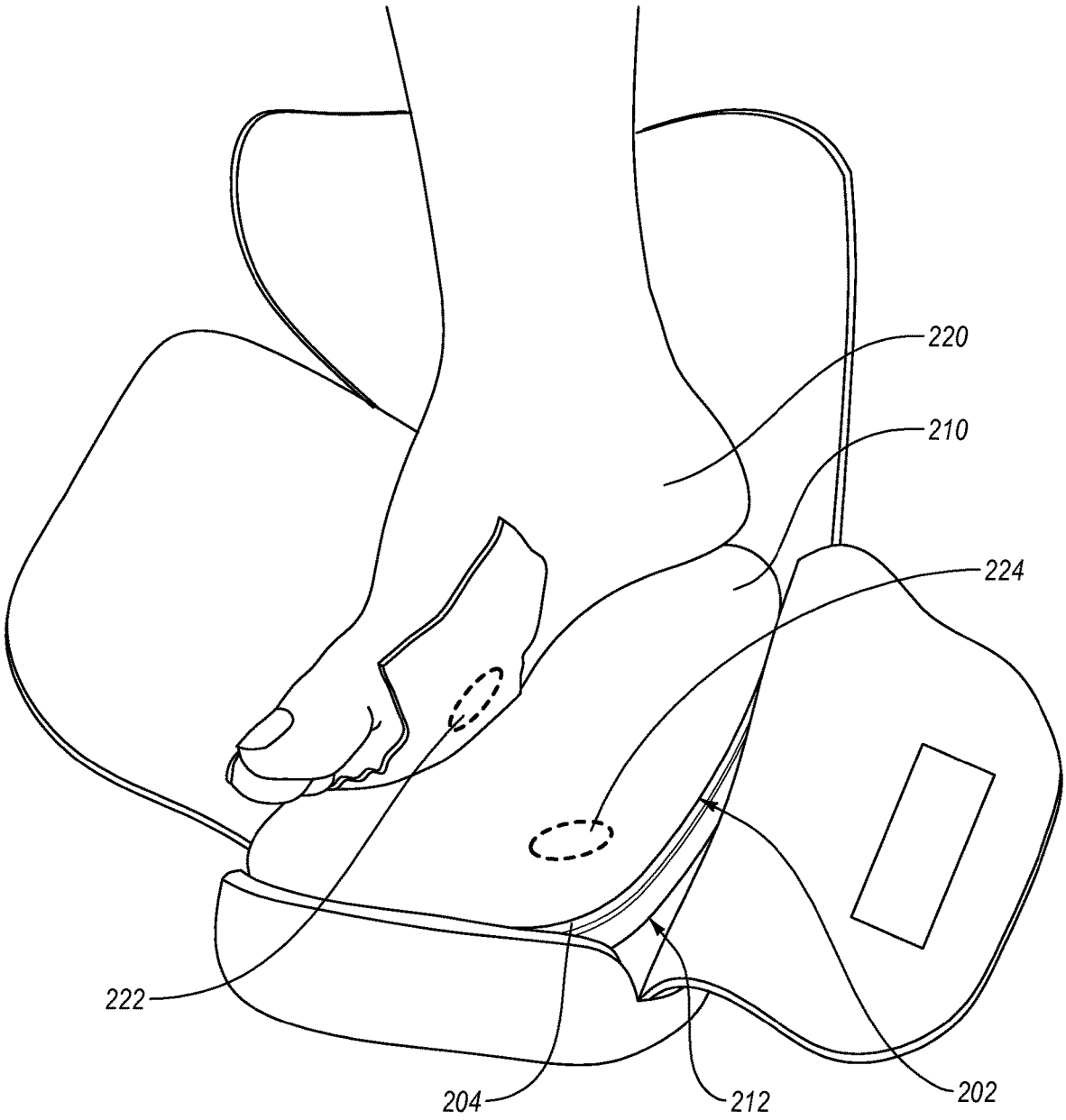
FIG. 5 is an isometric view of the walker of FIG. 1 partially disassembled for ease of reference.
Figure 6:
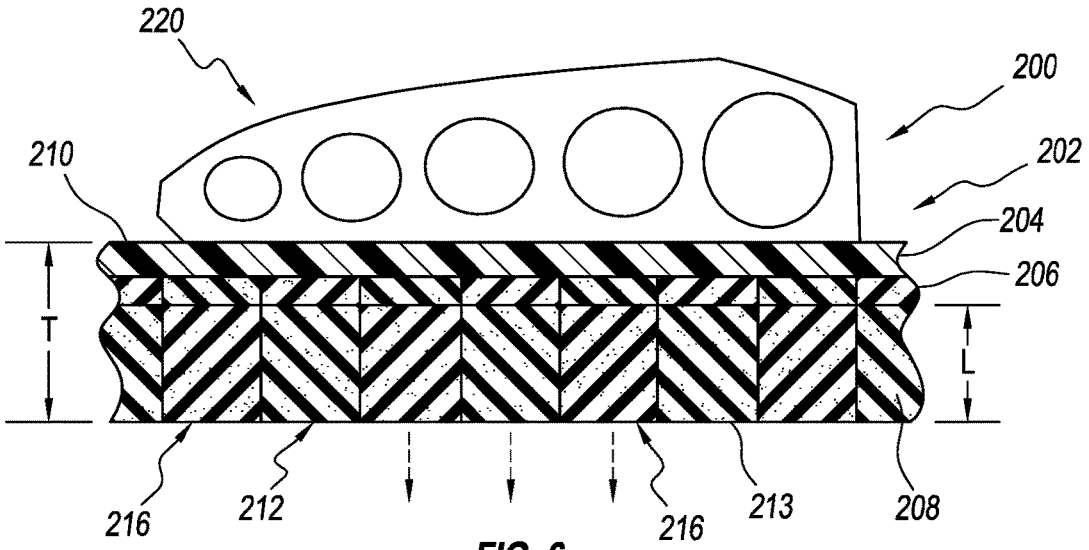
FIG. 6 is a cross-sectional view of the insole in FIG. 3.

As seen in FIG. 5, the plantar surface of the foot 220 can be supported on the top layer 204 and the removable elements 216 (shown in FIG. 4) surrounding the opening 218 (shown in FIG. 4). Relief can be provided to an affected area 222 on the plantar surface of the foot 220 by placing the affected area 222 on a relief zone 224 on the top surface 210 of the top layer 204. The relief zone 224 can correspond to the opening 218 formed below the top layer 204 and defined by removed removable elements 216.

As seen, the top surface 210 continuously spans over the opening 218. This means that the top surface 210 forms an uninterrupted protective barrier between the plantar surface of the foot 220 and the opening 218, reducing the likelihood that the edges of the openings 218 will form pressure points on the affected area 220, which can be both uncomfortable and harmful. This is important because conventionally, off-loading insoles have included removable shapes cut into and removable from the upper surface of the insole, creating edge pressures and/or pressure points on the plantar surface of the foot, which in turn, aggravate and/or even cause foot or pressure ulcers.

The top surface 210 continuously extending over the opening 218 can also distribute edge pressures from the opening 218 across and through the top layer 204 and away from the affected area 222. Such an arrangement also can limit or prevent "window edema." Window edema occurs when an area of the body under low pressure is surrounded by an area of higher pressure. Body fluids build up and become trapped in lower pressure. Distal parts of the body, such as the hands and feet, are prone to window edema because the cardio-vascular system rarely does a good job of retrieving fluids far from the heart. The trapped fluids become excellent media for bacteria to grow, causing infections.

Window edema can be especially problematic for diabetic users or patients using conventional insoles. For instance, fluids may build up and become trapped in the openings cut into and removable from the upper surface of the insole. Since the patient's foot is far from the heart, the cardio-vascular system has trouble carrying away the fluids that build up in the openings. As bacteria grow in the fluids, the patient may be subject to dangerous infection that can threaten the well-being of the foot and/or life of the patient.

The top surface 210 of the insole 200 continuously extending over the opening 218 reduces window edema by preventing the collection of fluids and/or exudate in the opening 218 rather than allowing the fluids and/or exudate to collect in the opening, as in the prior art. This also has the effect of limiting or preventing distended wounds because any exudate coming out of the affected area 222 generally cannot collect in the opening 218.

A user, a clinician, or medical professional can remove one or more of the removable elements 216 from the bottom portion 212 to define the opening 218, off-loading the affected area 222, without disrupting or breaching the contact area between the top surface 210 and the plantar surface of the foot 220. This allows the insole 200 to both comfortably support the foot 220 and offload the affected area 222. This also prevents the edges of one or more openings 218 rubbing against the plantar surface of the foot, reducing friction and shear forces.

Referring again to FIG. 4, the removable elements 216 can be arranged adjacent to one another in a grid pattern. The removable elements 216 can be configured to move laterally and/or vertically relative to one another in response to forces applied by the foot. The removable elements 216 can be configured to bend and compress relative to one another. The removable elements 216 can be deformable such that they sway and/or bend relative to one another.

The removable elements 216 can comprise independent pieces that work collectively to adjust and react to lateral foot motion. This has the effect of reducing shear stress on the plantar surface of the foot 220, which reduces the aggravation or creation of foot ulcers due to shear stress. Conventional insoles resist lateral foot motion, inducing shear stresses on the plantar surface of the foot, which can cause or aggravate ulcers. The top layer 204 can move with the underlying removable elements 216, helping to reduce shear stress on the plantar surface of the foot.

The removable elements 216 can be generally hexagonal in transverse cross-sectional configuration and can exhibit any other suitable construction. For instance, the removable elements 216 can be constructed in a similar configuration and function as described in U.S. Pat. No. 6,792,699 or U.S. Pat. No. RE 40,363, which are incorporated herein, in their entirety, by this reference. Each removable element 216 can have the same shape or different removable elements 216 can have different shapes.

The removable elements 216 can be removably attached to the insole 200 in any suitable manner. For instance, the top surfaces of the removable elements 216 can be lightly adhered to the bottom surface of the top layer 204 such that to remove elements 216 from the bottom portion 212, a user can selectively pull on the removable elements 216 to break the adhesive bond between the top surface of the removable elements 216 and the bottom surface of the top layer 204.

An adhesive bond between the top layer 204 and the intermediate layer 206 may be smaller than an adhesive bond between the intermediate layer 206 and the bottom layer 208. This can allow the adhesive bond between the top layer 204 and the intermediate layer 206 to fail or break before the adhesive bond between the intermediate layer 206 and the bottom layer 208 so the removable elements 216 do not fall apart at the interface between the intermediate layer 206 and the bottom layer 208.

The removable elements 216 can be removable from the bottom portion 212 by tearing the removable elements 216 out of the bottom portion 212. To remove one or more of the removable elements 216 from the bottom portion 212, a user, clinician, or medical professional can selectively twist or pull on the one or more elements 216 such that the intermediate layer 206 forming a portion of the removable elements 216 tears to remove the removable elements 216 from the bottom portion 212. The top layer 204 may have a tear strength about 1.2 times to about 20 times, about 5 times to about 15 times, about 7 times to about 12 times, or about 8 times to about 9 times greater than the tear strength of the intermediate layer 206. The bottom layer 208 may have a tear strength about 1.2 times to about 10 times, about 1.5 times to about 8 times, about 2 times, to about 6 times, or about 2.5 times to about 3 times greater than the tear strength of the intermediate layer 206.

The removable elements 216 can be removably attached to the insole via a hook-and-loop type system. For instance, the removable elements 216 can have a layer of hook type material on their top surfaces. This hook type material can engage a loop type material on or within a bottom surface of the top layer 204. The resultant securing action being of the hook-and-loop type, similar to Velcro®.

As seen in FIG. 4, the bottom portion 212 can include a continuous peripheral rim 226 at least partially enclosing the removable elements 216. The peripheral rim 226 can be configured to provide additional rigidity to the insole 200, reducing the likelihood that the insole 200 will sag along the peripheral edges of the insole 200. In particular, support provided by the peripheral rim 226 in combination with the removable elements 216 can help reduce the chance that an affected area of the user's foot will bottom out.

The peripheral rim 226 can have a higher density than at least some of the removable elements 216. The peripheral rim 226 can include one or more rigid or semi-rigid materials such as metals, composite materials, plastic materials or any other suitable material. The peripheral rim 226 can include one or more separate reinforcement members that can be inserted within the peripheral rim 226 to provide additional rigidity to the insole 200. The reinforcement members can include metal, plastic materials, composite materials, or any other suitable material. While the peripheral rim 226 is illustrated being continuous, in other embodiments, the peripheral rim 226 can be arranged along only portions of the insole 200. For instance, the peripheral rim 226 can be arranged along only a discrete portion of the bottom portion 212 to create at least one zone of additional support to the foot.

It will be appreciated that the layers of the top portion 202 and/or the bottom portion 212 can be attached to one another in any suitable manner. For instance, the intermediate layer 206 can be attached to the top layer 204 and/or the bottom layer 208 via one or more adhesives, hook-and-loop type systems, chemical bonding, mechanical bonding, or any other suitable technique. Optionally, the top layer 204 can include a piece of fabric or other material attached to its top surface, providing additional cushioning and/or friction reduction.

The top layer 204, the intermediate layer 206, and the bottom layer 208 together can define a total thickness T of the insole 200. Each layer 204, 206, 208 can include a layer thickness L defined between its top surface and bottom surface. The total thickness T of the insole 200 can be between about 13 mm and about 22 mm (e.g., about 18 mm). For instance, the top layer 204 can have a layer thickness L between about 3 mm and about 6 mm (e.g., about 5 mm), the intermediate layer 206 can have a layer thickness L of about 2 mm to about 4 mm (e.g., about 3 mm), and the bottom layer 208 can have a layer thickness L between about 8 mm and about 12 mm (e.g., 10 mm). In other embodiments, the total thickness T of the insole 200 and/or layer thicknesses can be more or less.

The total thickness T of the insole 200 can help ensure that the insole 200 is in substantially total contact with the plantar surface of the user's foot. For instance, if a user has a high arch, the insole 200 having a total thickness T of about 18 mm can be contacted substantially all the plantar surface of the foot, including the arch, without bottoming out. Conventional insoles for orthopedic devices can include five or more layers. The layers 204, 206, 208 can have the same total thickness T and support as a conventional insole, but with fewer layers, providing a more efficient and simpler insole construction.

The bottom portion 212 and/or the bottom layer 208 can also be oversized relative to the top portion 202 to help ensure that the removable elements 216 have an adequate height to create effective off-loading of an affected area. For instance, the layer thickness L of the bottom layer 208 can be greater than about 1.5 times, about 1.7 times, or about 2 times the layer thickness L of the top layer 204. The layer thickness L of the bottom layer 208 can be between about 1.2 times and about 2.2 times, about 1.5 times and about 2 times, or about 1.6 times and about 1.8 times greater than the layer thickness L of the top layer 204. In other embodiments, the relationship between the layer thicknesses L of the bottom layer 208 and the top layer 204 can be greater or smaller.

The bottom layer 208 can have a layer thickness L oversized relative to the top layer 204 such that the bottom layer 208 is arranged to provide the primary cushioning to the insole 200. It should be appreciated that the bottom layer 208 is a single layer providing the primary cushioning to the insole rather than multiple layers connected together as in the prior art. This allows the construction of the insole 200 to be simpler and less likely to fall apart due to weak or weakened connections between multiple layers.

The bottom layer 208 can have a layer thickness L oversized relative to the intermediate layer 206 such that the bottom layer 208 is arranged to provide the primary cushioning to the insole 200. The layer thickness L of the bottom layer 208 can be greater than about 1.5 times, about 1.8 times, about 2.2 times (e.g., about 2 times), or about 3 times the layer thickness L of the intermediate layer 206. The layer thickness L of the bottom layer 208 can be between about 1.5 times and about 3.5 times (e.g., about 3 times), about 2 times and about 3.2 times, or about 2.4 times and about 2.8 times greater than the layer thickness L of the intermediate layer 206. In other embodiments, the relationship between the layer thicknesses L of the bottom layer 208 and the intermediate layer 206 can be greater or smaller.

The intermediate layer 206 may be sized and arranged relative to the other layers to help cushion the insole 200. For instance, the intermediate layer 206 can have a layer thickness L arranged and sized to allow the intermediate layer 206 to compress and rebound between the top layer 204 and the bottom layer 208 as the user walks on the insole 200, providing greater cushioning and comfort. The layer thickness L of the top layer 204 can be greater than about 1.1 times, about 1.3 times, about 1.5 times, about 1.6 times, or about 2 times the layer thickness of the intermediate layer 206. The layer thickness of the top layer 204 can be between about 1 time and about 3 times, about 1.2 times and about 2 times, or about 1.4 times and about 1.7 times greater than the layer thickness L of the intermediate layer 206. In other embodiments, the relationship between the layer thicknesses L of the top layer 204 and the intermediate layer 206 can be greater or smaller.

Figure 7:
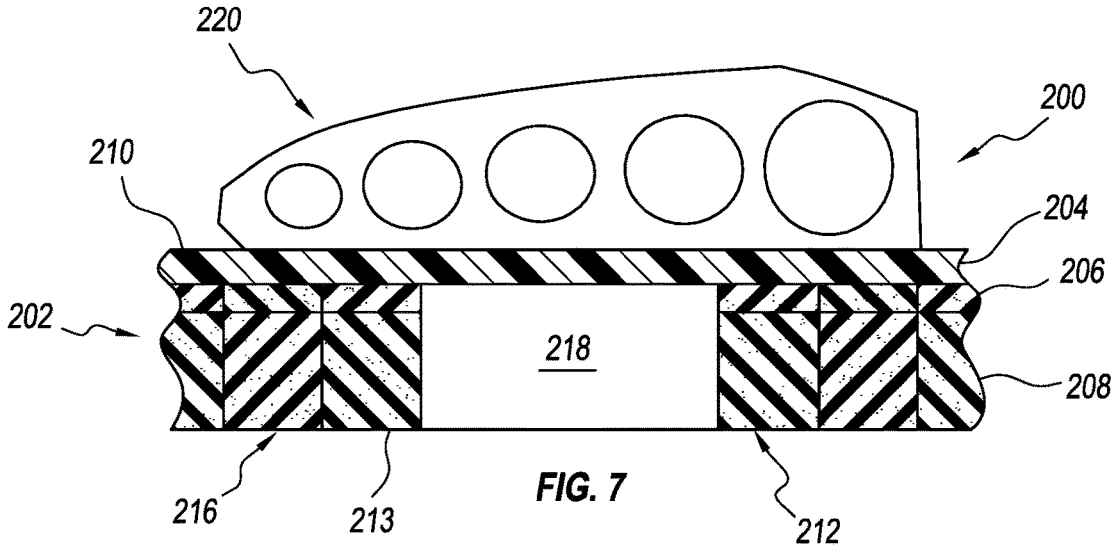
FIG. 7 is another cross-sectional view of the insole in FIG. 3 showing some of the removable elements removed for ease of reference.

FIG. 7 illustrates a cross-sectional view of the insole 200 with some of the elements removed for ease of reference. As seen, the removable elements 216 can extend through the intermediate layer 206 and the bottom layer 208, but not the top layer 204 (leaving at least the top surface 210 continuously extending over the opening 218 defined by the removed removable elements 216). The removable elements 216 are formed from a portion of the bottom layer 208 and a portion of the intermediate layer 206. Such an arrangement allows the top surface 210 and/or the top layer 204 to form a protective barrier between the plantar surface of the foot and the opening 218 and the removable elements 216, providing cushioning and/or reducing potentially harmful pressure points along the edges of the openings 218.

Figure 8A:
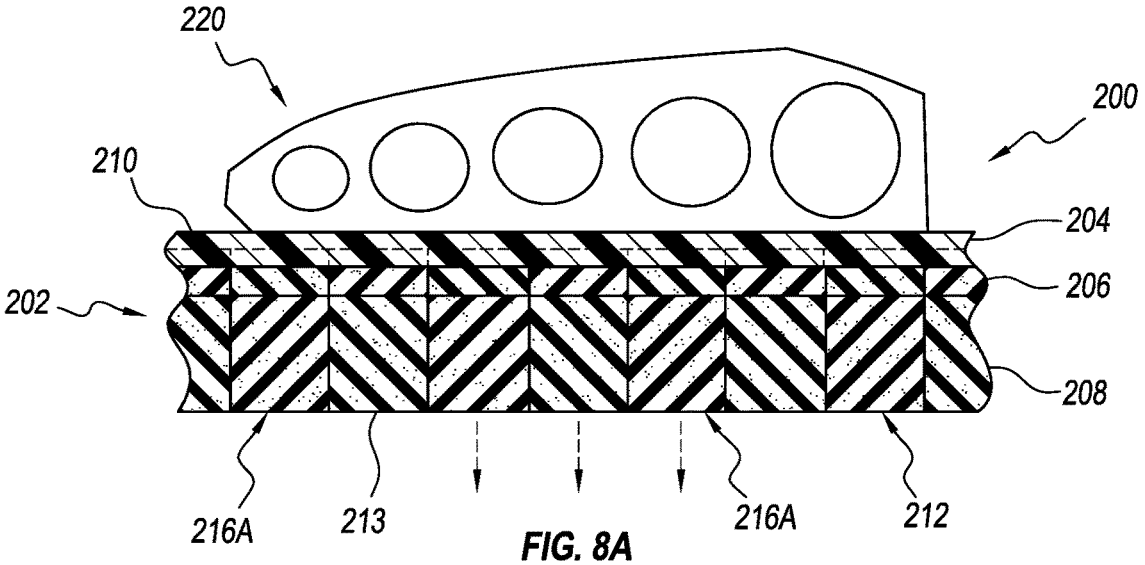
FIG. 8A is a cross-sectional view of an insole according to another embodiment.
Figure 8B:
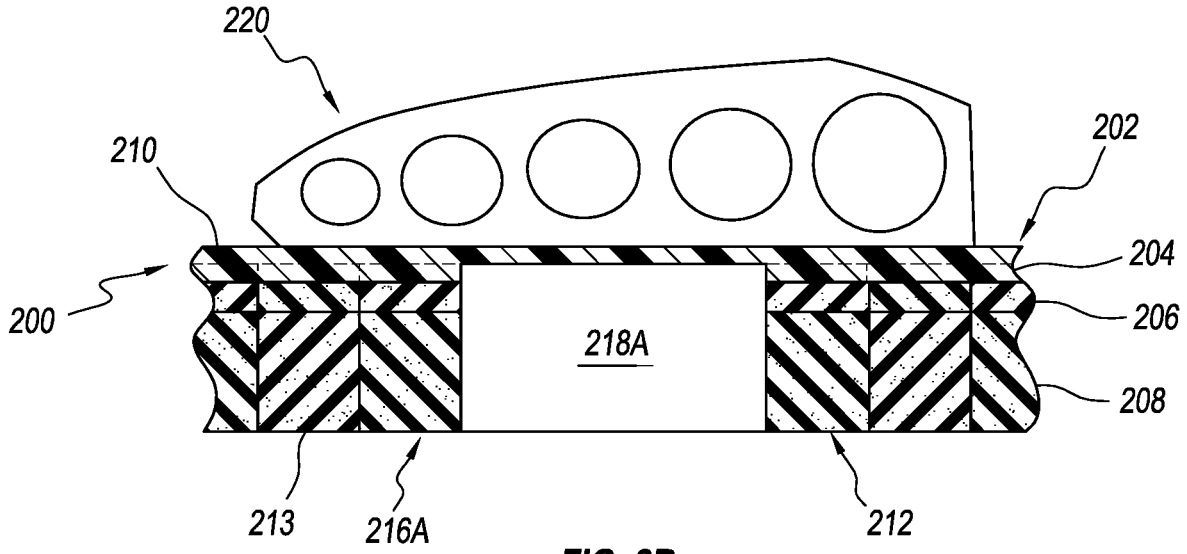
FIG. 8B is a cross-sectional view of the insole in FIG. 8A showing some of the removable elements removed for ease of reference.

Alternatively, as seen in FIGS. 8A and 8B, one or more of the removable elements 216A can be arranged for removal from the bottom portion 212 (including the bottom layer 208 and the intermediate layer 206) and at least part of the top layer 204 to define an opening 218A below the top surface 210 of the top layer 204. The removable elements 216A can be formed from a portion of the bottom layer 208, a portion of the intermediate layer 206, and a portion of the top layer 204. In other embodiments, the removable elements 216 can be arranged for removal from the bottom layer 208 and at least part of the intermediate layer 206 to define the opening 218 below the top surface 210. In other embodiments, the removable elements 216 can be arranged for removal from the bottom layer 208 to define the opening 218 below the top surface 210.

Each removable element 216 can have a height H (shown in FIG. 4) defined between a top and bottom surface of the removable element 216. The height H of the removable elements 216 can be arranged to facilitate removal of the removable elements to create off-loading of an affected area without the affected area "bottoming out" or displacing vertically below the bottom surface 213 of the bottom portion 212, which could negatively affect the affected area and potentially further injure the foot. At least one of the removable elements 216 can be arranged for removal from at least the bottom portion 212 such that the element 216 has a height H about 0.6, about 0.66, or about 0.7 times the total thickness T of the insole 200. In other embodiments, the height H of the removable elements 216 can be more or less. The height H of the removable elements 216 can be substantially the same. The height H of different elements 216 can be different.

The construction of the top portion 202 and the bottom portion 212 will now be discussed in greater detail. The top portion 202 and the bottom portion 212 can be configured to work together to provide greater comfort and support. The top layer 204 of the top portion 202 can be arranged to distribute pressure and/or to minimize friction by substantially conforming to the shape of the plantar surface of the foot. The top layer 204 can be heat-moldable. For instance, the top layer 204 can include one or more heat formable materials including, but not limited to, closed cell polyethylene foam (e.g., Plastazote® LD45), heat formable cork material, or any other suitable heat formable material.

To shape the top layer 204 to the plantar surface of the foot, the insole 200 may be heated to a temperature between about 90° C. and about 130° C. (e.g., about 110° C.) or above a softening temperature of the top layer 204, and the patient's foot or a mold of the user's foot applies to the insole to deform the top layer 204, so the shape of the upper surface of the top layer 204 substantially corresponds to the plantar surface of the foot. With this arrangement, the insole 200 can distribute forces from the foot to larger areas of the top layer 204 avoiding higher pressure points, with the lateral action of the removable elements 216 further reducing shear forces applied to the foot as the patient walks or stands on the insole 200. It will be appreciated that a broader range of operable temperatures for heat moldable materials are possible. In addition, instead of activating the molding by heat, other forms of activation may be employed such as, but not limited to, LED light, chemicals, or sound.

The bottom layer 208 of the bottom portion 212 can be sized and configured to provide additional support and/or comfort to the insole 200. The bottom layer 208 can include any suitable material. The bottom layer 208 can include a high density resilient material. The bottom layer 208 can be arranged to prevent the plantar surface of the foot 220 from bottoming out. For instance, as the bottom layer 208 is compressed under the weight of the user, the layer thickness L and compressive strength of the bottom layer 208 can be arranged to maintain the plantar surface of the foot 220 at a distance from the bottom surface 213 of the insole 200. The resiliency of the bottom layer 208 can also provide impact absorption and comfort.

The bottom layer 208 can be oversized relative to the other layers. This can allow the bottom layer 208 to create the primary cushioning in the insole 200. In addition, the oversized bottom layer 208 can help give the removable elements 216 adequate height H to create off-loading of an affected area without bottoming out. The bottom layer 208 may be heat formable such that the bottom layer 208 can be formed to substantially conform to the bottom of the user's foot. The top layer 204 and the bottom layer 208 can be formed to substantially conform to the shape of the plantar surface of the foot 220 in the same or separate processes.

The intermediate layer 206 of the bottom portion 212 can be configured to provide greater cushioning in the insole 200. The intermediate layer 206 can comprise a urethane foam (e.g., Poron® 4701-30), neoprene foam, silicone, rubber, or any other suitable material. The intermediate layer 206 can comprise a soft and resilient layer that provides impact absorption as the user walks on the insole 200. The intermediate layer 206 can comprise a compressible and resilient layer arranged to compress and rebound between the top layer 204 and the bottom layer 208 as the user walks on the insole 200, enhancing cushioning and comfort.

The softness of the insole 200 may vary from layer to layer. For instance, a harder top layer 204 and a harder bottom layer 208 can support the foot of the user and a softer intermediate layer 206 can compress and rebound between the top layer 204 and the bottom layer 208, providing an insole that is both strong and durable, while very comfortable for the user.

The top layer 204 can have a Shore oodurometer that is about 1.2 to about 30 times, about 1.5 times to about 25 times, about 8 times to about 20 times, or about 5 times to about 14 times greater than the Shore oodurometer of the intermediate layer 206. The bottom layer 208 may have a Shore oodurometer that is about 1.1 to about 10, about 1.2 times to about 8 times, about 2 times to about 6 times, or about 2.5 times to about 4 times, greater than the Shore oodurometer of the intermediate layer 206. The intermediate layer 206 can have a Shore oodurometer between about 3 and about 12 (e.g., about 5). The bottom layer 208 can have a Shore oodurometer between about 20 and about 80 (e.g., about 60), and the top layer 204 can have a Shore oodurometer between about 30 and about 70 (e.g., about 50). The bottom layer 208 can have a Shore oodurometer greater than about 60 and the top layer 204 can have a Shore oodurometer greater than about 50. In other embodiments, the hardness of the layers 204, 206, 208 can be more or less.

The materials and construction of the respective layers described are to be exemplary only, as any suitable materials and/or properties that can provide comfort and/or support to the insole 200 may be envisioned. For instance, the intermediate layer 206 can include heat deformable materials configured to be permanently deformed or contoured to the plantar surface of the foot.

The insole 200 can be any suitable shape and can be configured to fit a size, or size range of orthopedic devices or feet. For instance, the insole 200 can be made in extra-small, small, medium, larger and/or extra-large size.

The top portion 202 can include the top layer 204 and the bottom portion 212 can include the bottom layer 208 and the intermediate layer 206. In other embodiments, the top portion 202 can include the top layer 204 and the intermediate layer 206 and the bottom portion 212 can include the bottom layer 208.

Figure 9:
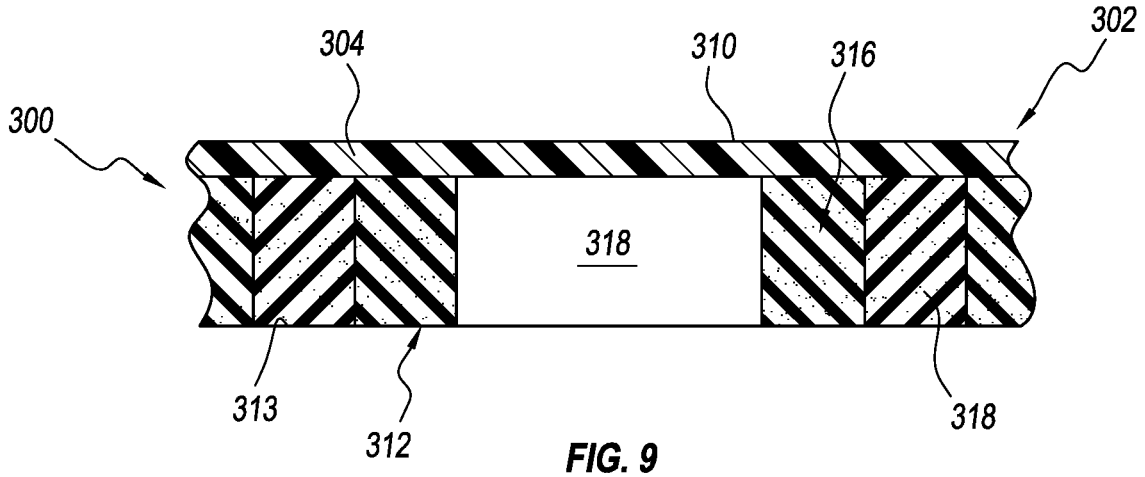
FIG. 9 is a cross-sectional view of an insole according to another embodiment showing some of the removable elements removed for ease of reference.

FIG. 9 illustrates a second exemplary embodiment of an insole 300. The insole 300 is similar to the insole 200 except that the insole 300 does not include an intermediate layer. The insole 300 has a top portion 302 and a bottom portion 312 connected to and arranged opposite the top portion 302. The top portion 302 includes a top layer 204 arranged to be substantially adjacent a plantar surface of a user's foot. The bottom portion 312 includes a bottom layer 308. The bottom layer 308 can define a bottom surface 313 of the bottom portion 312.

A plurality of removable elements 316 is arranged for removal from the bottom portion 312 for defining at least one opening 318 below the top layer 304, leaving the top layer 304 continuously spanning over the opening 318 and reducing the likelihood that the opening 318 will create pressure points on the plantar surface of the foot.

The bottom layer 308 can be substantially thickened or oversized relative to the top layer 304 to facilitate removal of the removable elements 316 of an adequate height to create off-loading of an affected area without the affected area bottoming out. For instance, the top layer 304 can have a layer thickness between about 3 mm and about 6 mm (e.g., about 5 mm) and the bottom layer can have a layer thickness between about 10 mm and about 16 mm (e.g., about 13 mm). In other embodiments, the thickness of the bottom layer 308 relative to the top layer 304 can be more or less.

Figure 10:
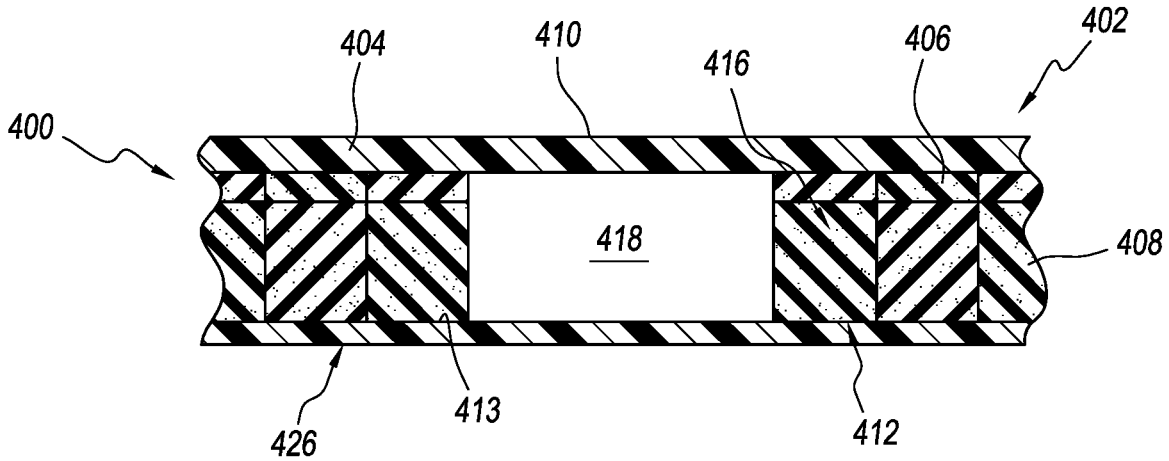
FIG. 10 is a cross-sectional view of an insole according to another embodiment showing some of the removable elements removed for ease of reference.

FIG. 10 illustrates a third exemplary embodiment of an insole 400 comprising a top portion 402 and a bottom portion 412 connected to and arranged opposite the top portion 402. The top portion 402 includes a top layer 204 defining a top surface 410 arranged to be substantially adjacent a plantar surface of a user's foot. The bottom portion 412 includes a bottom layer 408 and an intermediate layer 406. The bottom layer 408 can define a bottom surface 413 of the bottom portion 412.

A plurality of removable elements 416 is arranged for removal from the bottom portion 412 for defining at least one opening 418 below the top layer 404, leaving the top layer 404 continuously spanning over the opening 418.

A retaining member 426 can be removably attached to and positioned below the bottom portion 412. The retaining member 426 can be removably attached to a peripheral of the bottom surface 413 and/or the removable elements 416. The retaining member 426 can be arranged to selectively retain the removable elements 416 between the top layer 404 and the bottom surface 413 of the bottom portion 412. This has the effect of maintaining the position of the removable elements 416 within the insole, which limits undesired migration of the removable elements 416. The retaining member 426 can comprise a rigid plastic piece, an adhesive layer, a metallic or composite member, a rubber member, combinations thereof, or any other suitable member.

Figure 11:
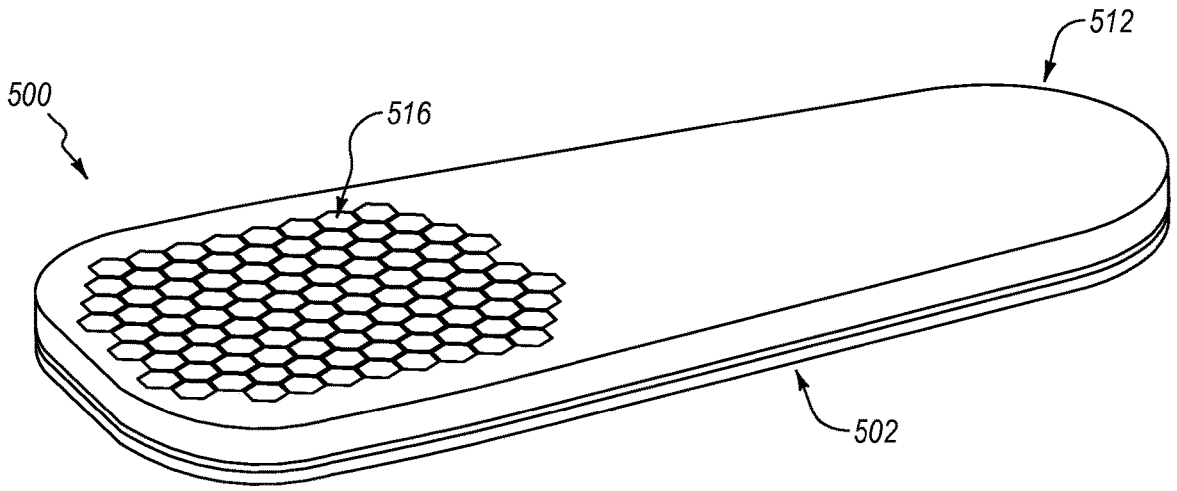
FIG. 11 is a bottom isometric view of an insole according to another embodiment.

FIG. 11 illustrates a fourth exemplary embodiment of an insole 500 comprising a top portion 502 and a bottom portion 512 connected to and arranged opposite the top portion 502. A plurality of removable elements 516 is arranged for removal from the bottom portion 412 to define at least one opening below a top surface of the top portion 502 for off-loading one or more affected areas of the plantar surface of the foot. The removable elements 516 can be limited to locations or regions where affected areas on the foot are commonly formed. For instance, the removable elements 516 can be arranged in only a forefoot region of the bottom portion 512 of the insole 500 as shown. The forefoot region is a common area for the formation of foot ulcers. In other embodiments, the removable elements 516 can be arranged in a toe region and/or the forefoot region of the bottom portion 512 of insole 500. The removable elements 516 can be arranged in the toe region, the forefoot region, and/or a heel region of the bottom portion 512 of the insole 500. If a user has Charcot foot and the user's arch is collapsing the removable elements 516 can be arranged in an arch region on the bottom portion 512 of the insole 500, allowing the insole 500 to provide relief to the user's malformed arch.

Figure 12:
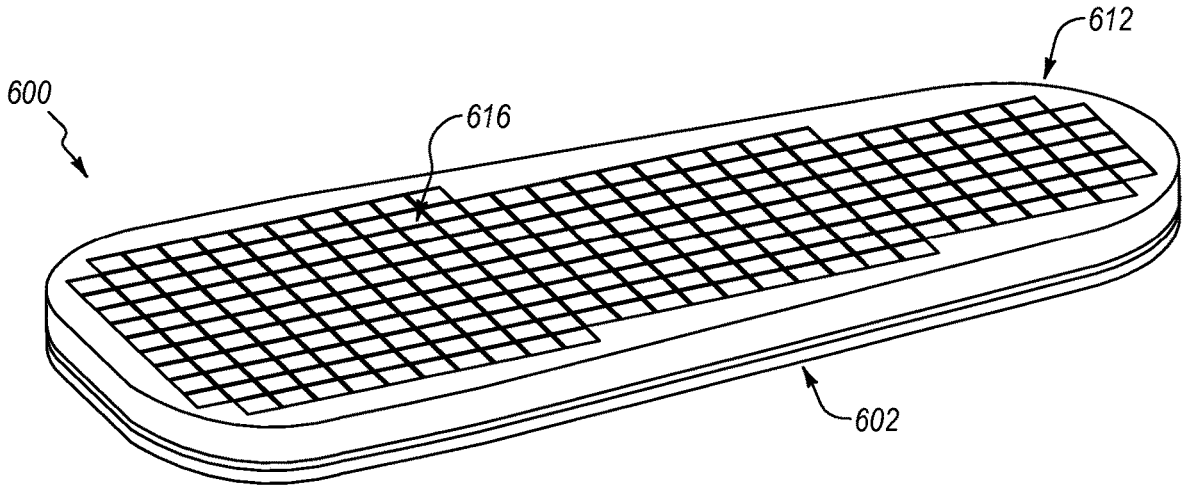
FIG. 12 is a bottom isometric view of an insole according to another embodiment.

While the removable elements are shown and described being generally hexagonal in transverse cross-sectional configuration, in other embodiments, the removable elements can be generally square, generally diamond, generally elliptical, combinations thereof, or any other suitable transverse cross-sectional configuration. For instance, FIG. 12 illustrates a fifth exemplary embodiment of an insole 600 comprising a top portion 602 and a bottom portion 612 connected to and arranged opposite the top portion 602. A plurality of removable elements 616 is arranged for removal from the bottom portion 612 to define at least one opening below a top surface of the top portion 602 for off-loading one or more affected areas of the plantar surface of the foot. As seen, the removable elements 616 can have a generally square cross-sectional configuration.

While various aspects and embodiments have been disclosed, other aspects and embodiments are contemplated. The aspects and embodiments disclosed are for illustration and are not intended to be limiting. The words "including," "having," and variants thereof (e.g., "includes" and "has") as used, including the claims, shall be open-ended and have the same meaning as the word "comprising" and variants thereof (e.g., "comprise" and "comprises").

The invention claimed is:

1. An insole for an orthopedic device comprising:

a first layer defining a foot engagement surface of the insole configured to face and engage with a plantar surface of a foot of a user, the foot engagement surface continuously extending between a toe edge portion and a heel edge portion of the insole;

a second layer defining a bottom surface of the insole configured to face away from the plantar surface of the foot, the second layer extending between the toe edge portion and the heel edge portion of the insole;

a third layer connecting and extending between the first layer and the second layer, the third layer being resiliently compressible such that the third layer compresses and rebounds between the first layer and the second layer as the user walks on the insole;

a plurality of removable elements formed from at least the second layer and the third layer and each extending downwardly from the first layer to an unattached lower end that is independently movable within the bottom surface of the insole relative to the first layer, at least one of the removable elements arranged for removal from the bottom surface of the insole for defining at least one opening below the foot engagement surface of the insole so that a thickness of the first layer extends over the at least one opening, the first layer extending over the at least one opening being continuous and covering an entirety of the foot engagement surface from the toe edge portion to the heel edge portion of the insole and from a medial side of the insole to a lateral side of the insole to enhance comfort and protection to the plantar surface of the foot, wherein the removable elements surrounding the at least one opening define an outer periphery of the at least one opening and move the foot engagement surface of the insole extending over the at least one opening to reduce shear stress on a plantar surface of the foot and accommodate lateral foot motion; and an adhesive bond between the first layer and the third layer, and an adhesive bond between the second layer and the third layer, wherein the adhesive bond between the first layer and the third layer is arranged to fail or break before the adhesive bond between the second layer and the third layer so the removable elements do not fall apart at the interface between the second layer and the third layer, the first layer having a tear strength between about 7 times to about 12 times greater than a tear strength of the third layer, the second layer having a tear strength between about 2.5 times to about 3 times greater than the tear strength of the third layer.

2. The insole of claim 1, wherein the first layer is heat formable such that the first layer is configured to match a shape of the plantar surface of the foot.

3. The insole of claim 2, wherein the second layer is heat formable such that the second layer is configured to match a shape of the plantar surface of the foot.

4. The insole of claim 1, wherein a combined thickness of the second layer and the third layer is greater than about twice the thickness of the first layer such that the foot engagement surface continuously spanning over the at least one opening remains vertically above the bottom surface of the insole as a user walks on the insole.

5. The insole of claim 1, wherein the second layer includes a high density resilient material such that the second layer is configured to maintain the foot engagement surface a distance from the bottom surface of the insole as a user walks on the insole.

6. The insole of claim 1, wherein the removable elements comprise only the second layer and the third layer.

7. The insole of claim 1, wherein the removable elements are arranged to move independently of one another.

8. An insole comprising:

a first layer defining a foot engagement surface of the insole configured to face and engage with a plantar surface of a foot of a user, the first layer extending between a toe edge portion and a heel edge portion of the insole;

a second layer defining a bottom surface of the insole configured to face away from the plantar surface of the foot, and a third layer connecting and extending between the first layer and the second layer, the first layer, the second layer, and the third layer being formed of different materials, the third layer being resiliently compressible such that the third layer compresses and rebounds between the first layer and the second layer as the user walks on the insole;

a plurality of removable elements formed from the first layer, the second layer and the third layer and each removable element extending downwardly from the first layer to an unattached lower end that is independently movable within the bottom surface of the insole relative to the first layer, at least one of the removable elements arranged for removal from the bottom surface of the insole for defining at least one opening below the foot engagement surface of the insole so that a thickness of the first layer extends over the at least one opening, the first layer extending over the at least one opening being continuous and covering an entirety of the foot engagement surface from the toe edge portion to the heel edge portion of the insole and from a medial side of the insole to a lateral side of the insole to enhance comfort and protection to the plantar surface of the foot, wherein the removable elements surrounding the at least one opening define an outer periphery of the opening and move with the foot engagement surface of the insole extending over the at least one opening to reduce shear stress on a plantar surface of the foot and accommodate lateral foot motion; and an adhesive bond between the first layer and the third layer, and an adhesive bond between the second layer and the third layer, wherein the adhesive bond between the first layer and the third layer is arranged to fail or break before the adhesive bond between the second layer and the third layer so the removable elements do not fall apart at the interface between the second layer and the third layer, the first layer having a tear strength between about 7 times to about 12 times greater than a tear strength of the third layer, the second layer having a tear strength between about 2.5 times to about 3 times greater than the tear strength of the third layer.

9. The insole of claim 8, wherein the first layer is heat formable such that the first layer is configured to match a shape of the plantar surface of the foot.

10. The insole of claim 9, wherein the second layer is heat formable such that the second layer is configured to match the shape of the plantar surface of the foot.

* * * * *